US005984247A

United States Patent [19]

Lühmann et al.

[11] Patent Number: 5,984,247

[45] Date of Patent: Nov. 16, 1999

[54] REDETACHABLE, SELF-ADHESIVE DEVICE WITH GRIPPING AID

[75] Inventors: Bernd Lühmann; Thomas Raadts, both of Norderstedt, Germany

[73] Assignee: Beiersdorf AG, Hamburg, Germany

[21] Appl. No.: 08/924,243

[22] Filed: Sep. 5, 1997

[30] Foreign Application Priority Data

Sep. 13, 1996 [DE] Germany ..... 196 37 221

[51] Int. Cl.[6] ..... A47G 1/17

[52] U.S. Cl. ..... 248/205.3; 248/683

[58] Field of Search ..... 248/683, 558, 248/467, 205.3

[56] References Cited

U.S. PATENT DOCUMENTS

| | | | |
|---|---|---|---|
| 4,181,553 | 1/1980 | Hogg | 156/211 |
| 4,605,577 | 8/1986 | Bowytz | 428/40 |
| 4,671,480 | 6/1987 | Frye | 248/205.3 |
| 4,756,498 | 7/1988 | Frye | 248/205.3 |
| 5,409,189 | 4/1995 | Luhmann | 248/205.3 |
| 5,507,464 | 4/1996 | Hamerski et al. | 248/683 |

FOREIGN PATENT DOCUMENTS 2642121 3/1978 Germany .

1599738 10/1981 United Kingdom .

OTHER PUBLICATIONS

International Application Under PCT, Kreckel et al., published Jul. 9, 1992, see all pages.

International Application Under PCT, Hamerski et al., published Sep. 29, 1994, see all pages.

*Primary Examiner*—Derek J. Berger
*Assistant Examiner*—Kimberly T. Wood
*Attorney, Agent, or Firm*—Sprung Kramer Schaefer & Briscoe

[57] ABSTRACT

Redetachable, self-adhesive device having a plate, the sides and/or front side of which have fastening means, if appropriate, and the rear side of which has a strip of an adhesive film which is adhesive on both sides and is adhesively attached in such a way that one end of the adhesive film protrudes beyond the plate as a grip, the adhesive film being of such a kind that the adhesive bond achieved with it can be released again by pulling in the direction of the bonding plane, stretching the strip, characterized in that the front side of the plate (1) has a gripping aid (5), by means of which the plate (1) can be held when releasing the adhesive bond again by pulling the strip (7).

13 Claims, 1 Drawing Sheet

REDETACHABLE, SELF-ADHESIVE DEVICE WITH GRIPPING AID

BACKGROUND OF THE INVENTION

1. Field of the Invention

The invention relates to a redetachable, self-adhesive device with gripping aid which can be released again from its adhesive bond without leaving any residue by pulling on the adhesive film, arranged on it, in the direction of the bonding plane.

2. Description of Related Art

Such devices, in particular hooks, are known. For instance, DE 42 33 872 C2 describes a redetachable, self-adhesive hook which is equipped with an adhesive film which can be adhesively released by pulling and which is commercially available as "tesa® Power-Strips with Hooks".

WO 94/21157 equivalent to U.S. Pat. No. 5,507,464 also discloses such a hook, which differs from the abovementioned hook in particular by the use of an adhesive film of the kind which is highly extensible and at the same time does not recover its original form.

In the practical use of such devices, problems may occur, however, in particular during later detachment.

What is particularly disadvantageous about the previous known problem solutions is that the releasing of the adhesive bond has to take place by pulling the adhesive strips substantially in the bonding plane, errors in use being inevitable for the inexperienced user.

In many cases it has been found that tears are caused by the user exerting considerable force to press the item to be released against the object to which it is adhesively bonded during the releasing process. As a result, the force necessary for pulling the adhesive tape out of the adhesive joint is increased to such an extent that the tearing resistance is exceeded, with the unfortunate consequence for the user that the adhesive tape tears and the adhesive bond can no longer be released non-destructively and without leaving any residue.

The object of the present invention was to overcome the aforementioned disadvantages.

BRIEF SUMMARY OF THE INVENTION

This object is achieved according to the invention by a redetachable, self-adhesive device having a plate, the sides and/or front side of which have fastening means, if appropriate, and the rear side of which has a strip of an adhesive film which is adhesive on both sides and is adhesively attached in such a way that one end of the adhesive film protrudes beyond the plate as a grip, the adhesive film being of such a kind that the adhesive bond achieved with it can be released again by pulling in the direction of the bonding plane, stretching the strip, characterized in that the front side of the plate (1) has a gripping aid (5), by means of which the plate (1) can be held when releasing the bond again by pulling the strip (7).

Preferred in this case is a device according to claim 1, characterized in that the gripping aid (5) is arranged at the end of the plate (1) which lies opposite the grip (8) of the strip (7).

Preferred is also a device according to claim 1, characterized in that the gripping aid (5) can be swung forwards.

Preferred is also a device according to claim 1, characterized in that the gripping aid (5) is formed together with the plate (1) as an injection-moulding part of plastic.

Preferred is also a device according to claim 1, characterized in that the gripping aid (5) is integrated into the plate (1).

Preferred is also a device according to claim 1, characterized in that the adhesive film, with or without an intermediate substrate, is elastically or plastically extensible.

Preferred is also a device according to claim 1, characterized in that the adhesion of the adhesive film is less than the cohesion, the adhesiveness is to a great extent dissipated when the film is extended, and the ratio of pulling-off force to tearing load is at least 1:1.5, the adhesive film being of the kind which is based on thermoplastic rubber and tackifying resins, with high elasticity and low plasticity.

Preferred is also a device according to claim 1, characterized in that the rear side of the adhesive film (7) is covered with a release laminate, such as a siliconized release paper or a release film.

Preferred is also a device according to claim 1, characterized in that at the sides of the plate (1) there are engagement devices (4), into which a corresponding hook or the like can be engaged.

Redetachment without tearing is accordingly achieved in particular by there being integrated into the plate a gripping aid which allows the plate to be fixed with the hand, using the gripping aid, during the detachment process in such a way that the plate remains substantially free from forces acting perpendicularly with respect to the bonding direction during stripping out of the adhesive film.

According to the invention, suitable in particular as adhesive films are those corresponding to DE 33 31 016, DE 42 22 849, DE 42 33 872, WO 92/11333 and WO 94/21157.

For instance, DE 33 31 016 A1 describes an adhesive film for re-releasable adhesive bonds which allows an adhesive bond established therewith to be releasable by pulling on the adhesive film in the direction of the bonding plane. With such adhesive films, high adhesive forces and shear strengths can be achieved and adhesive bonds can be released again without further aids, in a way comparable to the opening of a preserving jar, similar to the way in which there the rubber seal is pulled by the grip out of the seal joint.

DE 42 22 849 C1 describes such an adhesive film with a UV-impermeable grip.

WO 92/11333 also describes, inter alia, adhesive films for corresponding applications, the adhesive films used having a low elasticity with at the same time high extension.

Double-sided self-adhesive tapes with a foam intermediate substrate, for example of polyethylene foam, can also be used according to the invention.

In general, for production, processing and handling of the particularly preferred adhesive films, reference is made to DE 33 31 016, DE 42 22 849 and WO 92/11333.

Suitable as the plate or moulding, in particular as base plates, are:

plastic, metal, wood (coated, for example painted, and uncoated), ceramic and the like.

Devices according to the invention serve for receiving one side of the adhesive film, the other side of which is adhesively bonded onto the selected underlying surface. A wide variety of adapters, including hook bodies, can be placed onto the plate. To produce a high bonding strength, the surface of the plate on the side to which the adhesive film is applied consists in particular of a material which has an adhesion with respect to the adhesive film which is adequate for the respective application. When using contact adhesives based on styrene block copolymers or acrylate copolymers, advantageously used in this case are, inter alia, polystyrene, impact-modified polystyrenes, PMMA, aromatic polyesters, polycarbonate or polyamide.

Redetachment without tearing is achieved in particular by there being integrated into the plate a gripping aid which allows the plate to be fixed with the hand, using the gripping aid, during the detachment process in such a way that the base plate remains substantially free from forces acting perpendicularly with respect to the bonding direction during stripping out of the adhesive film. Possible ways of accomplishing such a gripping aid include the integration of a grip which is firmly connected to the plate by means of a flexible connection and can be swung out. A corresponding gripping aid may, for example, be integrated into the base plate directly during injection moulding, but may also be applied separately. One specific formation is that of a self-adhesive tape applied to the rear side of the base plate.

During stripping off of the adhesive film, the plate is fixed by means of the gripping aid, using the thumb and index finger. The fact that the fixing point lies outside the body of the plate in the opposite direction to the pulling-off direction of the adhesive film has the effect that only low forces act perpendicularly with respect to the bonding plane. Tearing as a result of excessive contact pressure perpendicularly with respect to the bonding plane is consequently ruled out.

The invention is to be described below with reference to examples and figures, without however wishing to restrict it unnecessarily.

DETAILED DESCRIPTION OF THE INVENTION

Figure 1:
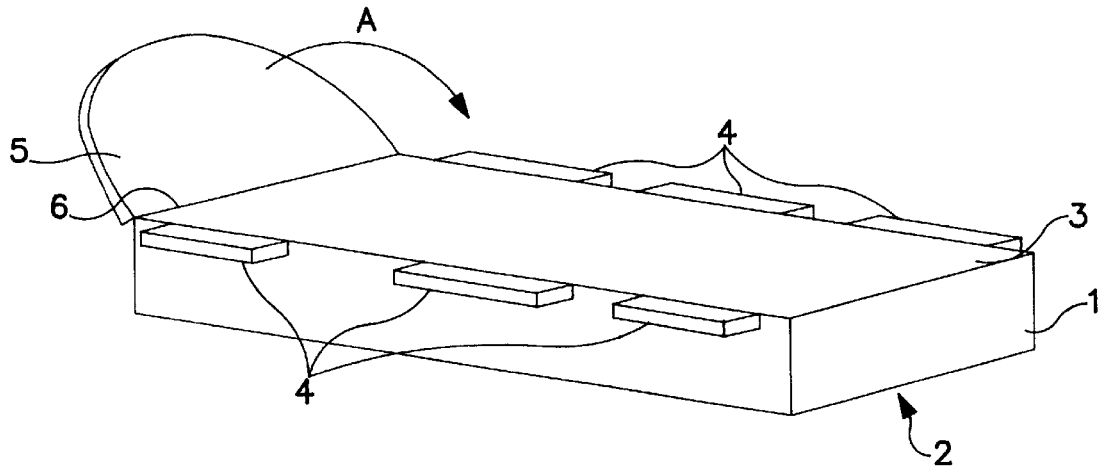
FIG. 1 shows a plate according to the invention in an obliquely lateral view.

To be specific, FIG. 1 shows a plate with a rear side 2 and a front side 3, there being arranged on both longitudinal sides engagement devices 4 which are designed such that they can engage with corresponding engagement devices, for example of an attachment hook or the like, for instance on the basis of the system hook as available for tesa® Power Strips. Arranged at one end of the plate 1 is a gripping aid 5, which can be gripped and held well by hand. The gripping aid 5 can be swung about a film hinge 6 in the direction of the arrow A onto the plate 1, so that it rests on the latter out of the way and, if appropriate, disappears in a recess (not shown).

Figure 2:
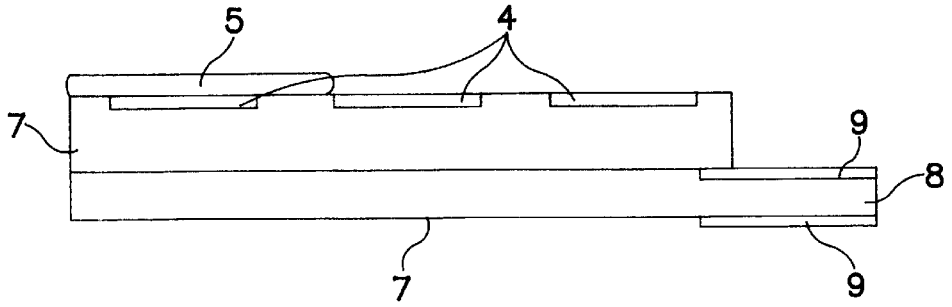
FIG. 2 shows a side view according to FIG. 1, with an adhesively attached adhesive film strip.

In FIG. 2 it is shown how the gripping aid 5 is swung onto the plate 1, while on the other side of the plate 1 there is adhesively attached a strip 7 of an adhesive film, with grip 8 and covering films 9 on the grip.

EXAMPLE

For a single-layer adhesive film of the formulation:

50 parts of Foralyn 110 (Hercules), 50 parts of Vector 4211 (Exxon), 0.5 parts of Irganox 1010 (Ciba)

of a thickness of 650 $\mu$m, a maximum tensile force of 52 N/cm, corresponding to 8.0 MPa, and an ultimate elongation of 1300% are determined.

Rectangular pieces of the adhesive film measuring 20 mm×50 mm are adhesively bonded centrally to base plates consisting of polystyrene (Vestyron 214; Hüls) of the dimensions 3 mm×40 mm×22 mm (height×length×width) in such a way that the base plates are covered on one side over their entire length by the adhesive film and a 10 mm long strip of adhesive film protrudes beyond one of the short sides of the base plate, which can be used as a grip for later detachment. The base plates provided with adhesive films are adhesively bonded onto chipboards provided with painted wood-chip wallpaper (wallpaper: Erfurt Körnung 52; paint: Herbol Zenit LG). For this purpose, the base plates provided with the adhesive films are applied flatly to the underlying wallpaper surface and pressed onto it with 500 N for 5 seconds. In a second operation, for detaching the adhesive films, the test pieces fixed in this way are subjected to forces of different amounts acting vertically onto the bonding plane, and at the same time the adhesive film strips are pulled out of the adhesive joint at an angle of <5 degrees with respect to the bonding plane at separation rates of about 1000 mm/min. The maximum detaching force (max. stripping force) is assessed, and whether the adhesive film strips can be released from the adhesive joint without tearing.

Used to provide a comparison are base plates which are additionally provided on the base plate rear side with a self-adhesive fabric tape (tesa band 4651) of the dimensions 80 mm×20 mm, in such a way that pieces of the fabric tape each of 50 mm×20 mm are adhesively bonded centrally over the entire length of the base plates and the remaining ends of 30 mm×20 mm are bonded on themselves over half the length. Consequently, from the base plate rear sides there protrudes in each case over a short edge of the base plates a 15 mm×20 mm fabric tape grip. Base plates modified in this way are adhesively bonded onto Resopal in an identical way to the abovementioned procedure. For detachment, the fabric tape grips are fixed using the index finger and thumb of the left hand and the adhesive film strips are pulled out of the adhesive joint, using the right hand, at an angle of <5 degrees with respect to the bonding plane at separation rates of about 1000 mm/min. The maximum measured detaching force is assessed, and whether the adhesive film strips can be released again from the adhesive joint without tearing. The following test results are obtained:

| Type of base plate | Vertical pressing force// maximum detaching force | | Test result |
|---|---|---|---|
| Without fabric tape | Without | 9 N/cm | Can be detached without tearing |
| Without fabric tape | 20 N | 17 N/cm | Can be detached without tearing |
| Without fabric tape | 100 N | >25 N/cm | Adhesive film tears |
| Without fabric tape | 500 N | >25 N/cm | Adhesive film tears |
| With fabric tape | — | 9 N/cm | Can be detached without tearing |

By relocating the fixing of the base plate away from the actual body of the base plate, the exertion of a pressing force acting vertically on the bonding plane is eliminated to the greatest extent, so that the adhesive films can be released from the adhesive joint with low maximum detaching forces and without tearing.

We claim:

1. Redetachable, self-adhesive article-supporting device adapted to be adhesively adhered to a substrate comprising a base plate (1), optionally adapted to carry an article support fastener said base plate having a front and a rear side and two longitudinal sides, the read side of the base plate having adhesively adhered thereto a strip of stretch release adhesive film (7), which is adhesive on both sides, in such a way that one end of the adhesive film protrudes beyond the base plate (1) forming a grip (8), the side of the adhesive film not adhered to the base plate being adapted to secure the device to a substrate, the adhesive film being such that an adhesive bond achieved between the base plate and the substrate can be released by stretching the film by pulling in a direction of a plane formed between the base plate and the substrate, the front side of the plate (1) having a gripping aid (5) attached to the base plate (1) but not to the stretchable adhesive film (7), the gripping aid (5) protruding beyond the base plate in a direction opposite the grip (8) adapted to be held to provide a counter force when releasing the adhesive bond by pulling the adhesive film (7) in a direction of the bond.

2. Device according to claim 1, wherein gripping aid (5) is positioned at the end of base plate (1) which lies opposite the grip (8) of adhesive film (7).

3. Device according to claim 1, wherein the gripping aid (5) is formed together with the base plate (1) as an injection-molded part of plastic.

4. Device according to claim 1, wherein the gripping aid (5) is integrated into base plate (1).

5. Device according to claim 1, wherein the adhesive film, optionally comprising an intermediate substrate, is elastically or plastically extensible.

6. Device according to claim 1, wherein the adhesion of the adhesive film (7) is less than the cohesion, the adhesiveness is to a great extent dissipated when the film is extended, and the ratio of pulling-off force to tearing load is at least 1:1.5, the adhesive film being of a kind which is based on thermoplastic rubber and tackifying resins, with high elasticity and low plasticity.

7. Device according to claim 1, wherein a rear side of adhesive film (7) is covered with a release laminate.

8. Device according to claim 7, where the release laminate is a siliconized release paper or a release film.

9. Device according to claim 1, wherein the counter force is applied such that the base plate (1) remains substantially free of forces acting perpendicularly with respect to the direction of the bond.

10. Device according to claim 1, which further comprises an article support fastener.

11. Device according to claim 1, which further includes engagement devices (4) protruding from the longitudinal sides of base plate (1) into which a corresponding article support fastener can be engaged.

12. Redetachable, self-adhesive article-supporting device adapted to be adhesively adhered to a substrate comprising a base plate (1), optionally adapted to carry an article support fastener, said base plate having a front and a rear side and two longitudinal sides, the rear side of the base plate having adhesively adhered thereto a strip of stretch release adhesive film (7), which is adhesive on both sides, in such a way that one end of the adhesive film protrudes beyond the base plate (1) forming a grip (8), the side of the adhesive film not adhered to the base plate being adapted to secure the device to a substrate, the adhesive film being such that an adhesive bond achieved between the base plate and the substrate can be released by stretching the film by pulling in a direction of a plane formed between the base plate and the substrate, the front side of the plate (1) having a gripping aid (5) attached to the base plate (1) but not to the stretchable adhesive film (7), the gripping aid (5) protruding beyond the base plate in a direction opposite the grip (8) adapted to be held to provide a counter force when releasing the adhesive bond by pulling the adhesive film (7) in a direction of the bond, wherein said gripping aid (5) is rotatable such that the gripping aid (5) can be folded onto the base plate.

13. Redetachable, self-adhesive article-supporting device adapted to be adhesively adhered to a substrate comprising a base plate (1), optionally adapted to carry an article support fastener, said base plate having a front and a rear side and two longitudinal sides, the rear side of the base plate having adhesively adhered thereto a strip of stretch release adhesive film (7), which is adhesive on both sides, in such a way that one end of the adhesive film protrudes beyond the base plate (1) forming a grip (8), the side of the adhesive film not adhered to the base plate being adapted to secure the device to a substrate, the adhesive film being such that an adhesive bond achieved between the base plate and the substrate can be released by stretching the film by pulling in the direction of a plane formed between the base plate and the substrate, the front side of the plate (1) having gripping aid (5) attached to the base plate (1) but not to the stretchable adhesive film (7), the gripping aid (5) protruding beyond the base plate in a direction opposite the grip (8) adapted to be held to provide a counter force when releasing the adhesive bond by pulling the adhesive film (7) in a direction of the bond, wherein said gripping aid (5) comprises an adhesive tape provided with a grip.

* * * * *